US008225577B1

(12) United States Patent
Fender

(10) Patent No.: US 8,225,577 B1
(45) Date of Patent: Jul. 24, 2012

(54) PRODUCING IN-GROUND SPAS OR POOLS FROM CONCRETE POURS AROUND LINER-LIKE CORES, AND CORE PRODUCTS

(76) Inventor: Douglas L. Fender, Nixa, MO (US)

( * ) Notice: Subject to any disclaimer, the term of this patent is extended or adjusted under 35 U.S.C. 154(b) by 864 days.

(21) Appl. No.: 11/881,812

(22) Filed: Jul. 26, 2007

Related U.S. Application Data

(63) Continuation-in-part of application No. 11/711,504, filed on Feb. 27, 2007, now abandoned, which is a continuation of application No. 11/634,805, filed on Dec. 6, 2006, now abandoned.

(60) Provisional application No. 60/742,851, filed on Dec. 6, 2005.

(51) Int. Cl.
*E04B 1/04* (2006.01)

(52) U.S. Cl. ..... 52/742.1; 52/741.13; 52/741.15; 52/741.12

(58) Field of Classification Search ..... 52/741.12, 52/741.13, 169.7, 741.11, 742.1, 742.14; 264/35, 333; 405/44, 267
See application file for complete search history.

(56) References Cited

U.S. PATENT DOCUMENTS

| | | | | |
|---|---|---|---|---|
| 2,887,759 | A * | 5/1959 | Brownell, Jr. | 52/741.12 |
| 3,355,897 | A | 12/1967 | Mullen, Jr. | 405/268 |
| 3,592,435 | A | 7/1971 | Mattingly | 249/1 |
| 3,643,908 | A | 2/1972 | Laing | 249/27 |
| 4,060,946 | A * | 12/1977 | Lang et al. | 52/169.7 |
| 4,406,439 | A | 9/1983 | Garter | 249/64 |
| 4,464,802 | A | 8/1984 | Glonek et al. | 4/506 |
| 4,818,142 | A | 4/1989 | Cochran | 405/55 |
| 4,976,088 | A | 12/1990 | Powers | 52/742 |
| 5,695,089 | A * | 12/1997 | Reese et al. | 220/560.03 |
| 5,727,264 | A * | 3/1998 | Craig et al. | 4/489 |
| 6,247,702 | B1 * | 6/2001 | Long et al. | 277/417 |
| 6,606,836 | B2 * | 8/2003 | Miller | 52/741.14 |
| 6,810,537 | B1 * | 11/2004 | Barnes et al. | 4/507 |
| 7,089,607 | B2 * | 8/2006 | Barnes et al. | 4/508 |

* cited by examiner

*Primary Examiner* — Eileen D Lillis
*Assistant Examiner* — Alp Akbasli
(74) *Attorney, Agent, or Firm* — Jonathan A. Bay

(57) ABSTRACT

A method of using liner-like cores or core assemblies for creating in-ground concrete spas or swim pools. For larger projects, that is for enlarged scale spas or swim pools, the inventive liner-like core comprises an assembly of sections. The cores or core assemblies are re-usable at least for several projects if reasonably maintained and cleaned. The core assembly comprises two long walls and two short wall defining the perimeter around a split level bottom with a shallow end, a deep end, and an intermediate transition slope. The liner-like core is constructed from a suitable rigid material like fiberglass for stiffening purposes and is an assembly of sections and also comprises: leveling blocks, transverse support beams, and hangers that attach to the walls of the core assembly and stiffens the long walls against being warped inward during the concrete pour.

9 Claims, 7 Drawing Sheets

PRODUCING IN-GROUND SPAS OR POOLS FROM CONCRETE POURS AROUND LINER-LIKE CORES, AND CORE PRODUCTS

CROSS-REFERENCE TO RELATED APPLICATION(S)

This application is a continuation-in-part of U.S. patent application Ser. No. 11/711,504, filed Feb. 27, 2007 now abandoned, which is a continuation of U.S. patent application Ser. No. 11/634,805, filed Dec. 6, 2006 now abandoned, which claims the benefit of U.S. Provisional Application No. 60/742,851, filed Dec. 6, 2005.

All the foregoing are incorporated herein by this reference.

BACKGROUND AND SUMMARY OF THE INVENTION

The invention relates to construction of in-ground concrete spas or swim pools and, more particularly, to liner-like cores or core assemblies for creating in-ground concrete spas or swim pools.

It is a preference of the invention that for larger projects, that is for enlarged scale spas or swim pools, the inventive liner-like core comprises an assembly of sections.

It is an alternate preference of the invention that the liner-like cores or core assemblies are re-usable at least for multiple projects if reasonably maintained and cleaned.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
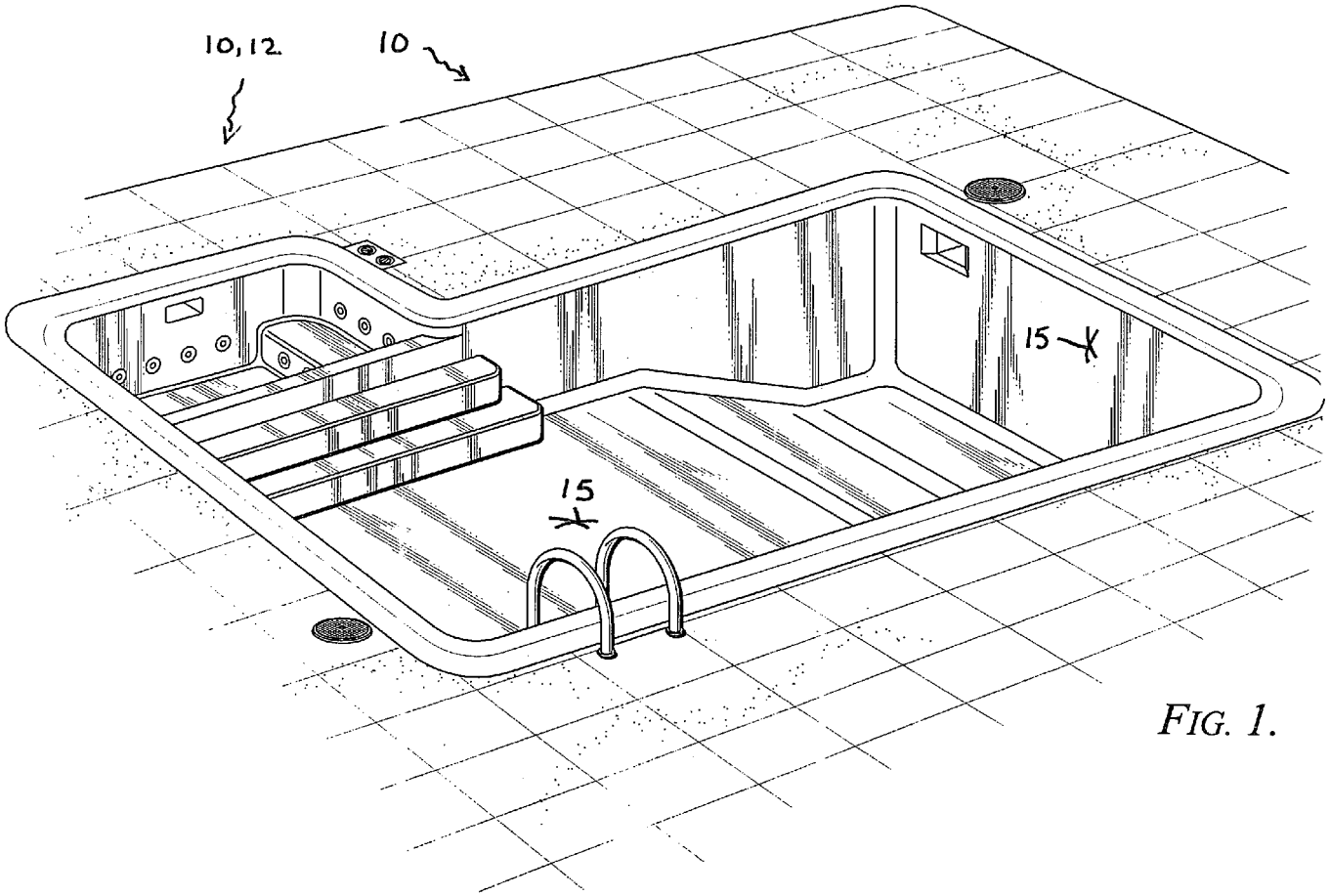
FIG. 1 is a perspective view of an in-ground concrete swim pool in accordance with the invention, produced by practicing a construction method in accordance with the invention.
Figure 2:
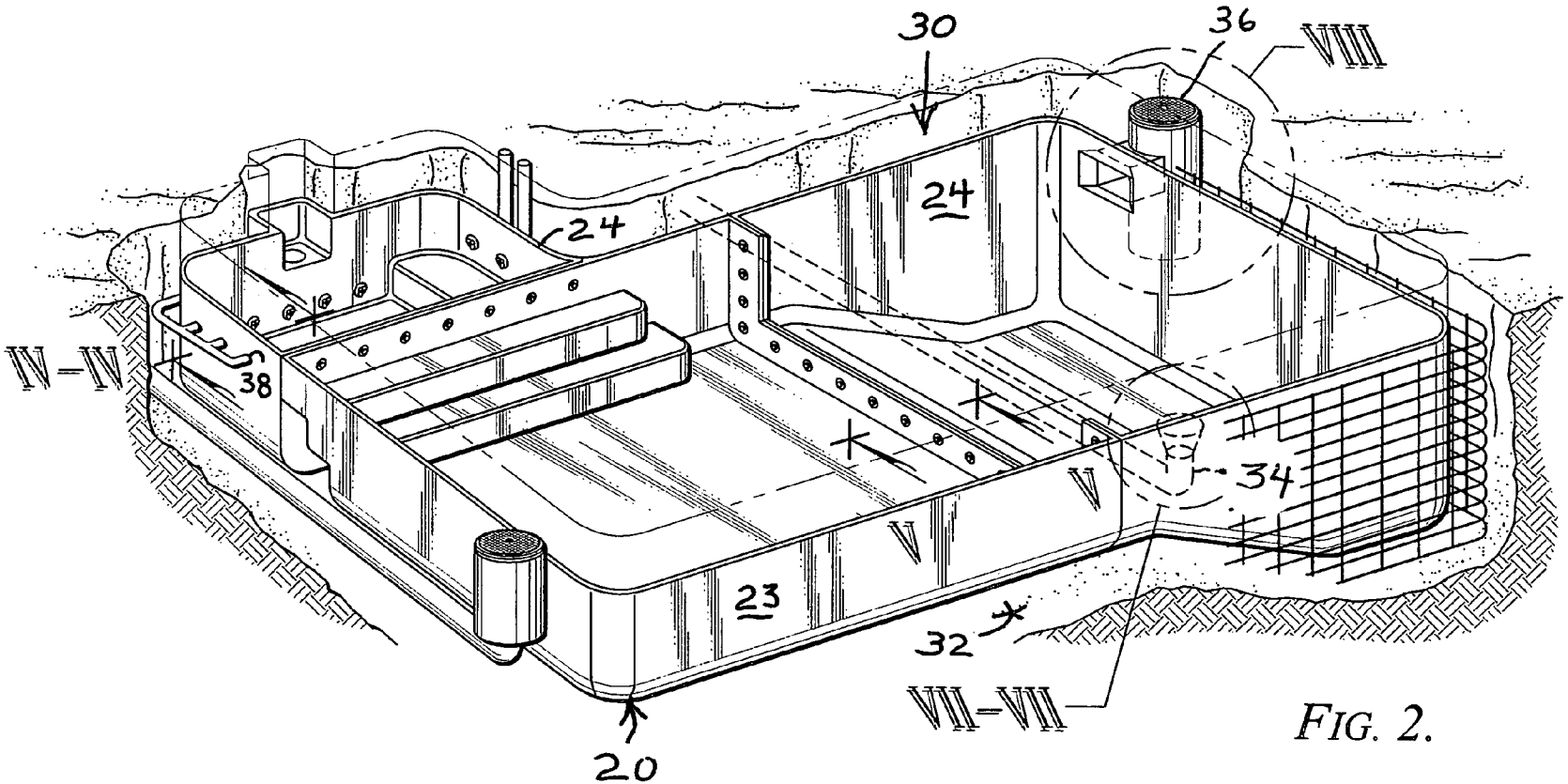
FIG. 2 is a perspective view comparable to FIG. 1 except showing a relatively early stage of the construction method in accordance with the invention, for producing in-ground spas or pools in accordance with the invention, from concrete pours around a liner-like core or core assembly in accordance with the invention.

FIG. 1 shows an in-ground concrete swim pool 10 in accordance with the invention, produced by practicing a construction method in accordance with the invention. FIG. 2 et seq. show the method and means in accordance with the invention for producing such an in-ground swim pool 10 by the pouring of concrete around a liner-like core or core assembly 20 in accordance with the invention.

A liner-like core 20 in accordance with the invention is preferably constructed from a suitable rigid material like fiberglass or the like. Fiberglass is advantageous because, among other advantages, it is lightweight and can be produced in complex shapes including with peripheral flanges and interior ribs for stiffening purposes.

The core or core assembly 20 serves as form around which the cavity 15 of a concrete swim pool or spa shell takes its shape. In FIG. 1, this swimming pool 10 is provided with an adjoining spa 12, which likely is lined with a shell (not shown). The core 20 in accordance with the invention can be configured to provide a stand-alone cavity for a spa by itself, not adjoining a pool (this is not shown).

It is preferred that the core (if a monolithic unit, eg, as something resembling core section 24 by itself) or core sections (eg., 22-24) for a core assembly 20 are manufactured beforehand (well beforehand) and off the project site. Indeed it more preferential that the core (if a monolithic unit) or core sections 22-24 are manufactured in a main factory, then stored during non-use at geographically-distributed sites for transport to relatively local but distributed project sites for the occasion of use and pouring the concrete. One-piece cores are satisfactory for small scale projects (eg., spas) but for large scale projects, the restrictions of what size highway transportation will permit shall determine the practical size of the several sections (eg., 22-24) it will take to assemble the completed core assembly 20 on the project site. That is, the core sections 22-24 can be made as big as trailer homes so long as the applicable highway transportation rules allow them to be transported by trailer at that size. After being brought to a project site, the core sections 22-24 can be assembled into the completed core assembly 20, which might be grand in size indeed.

Hence it is a preference of the invention to create not only spas (eg., 12) but also enlarged-scale pools (eg., 10) from a core assembly (eg., 20) assembled from multiple core sections (eg., 22-24) tile together to make a unified liner-like core.

FIG. 2 et seq. show a swim pool construction project being undertaken in accordance with the invention. The swim pool 10's cavity 15 is defined by the outer contour of the core assembly 20. At some earlier time, an oversized pit 30 was excavated out of the ground. The pit 30 is prepped for the concrete pour by laying a compacted-gravel base 32 about six inches (~fifteen cm) thick or so, and covered by two layers of half-inch (~1¼ cm) diameter rebar in spaced lanes one foot (~thirty cm) apart, and crisscross to each other to make a grid (not shown). Preferably a vertical cage-work of rebar along the sidewalls is included (see, eg., FIG. 2 or 3) but is minimized in favor of a strong strengthening hoop extending all along the rim perimeter of the pool (eg., one-inch, or ~2½ cm, diameter rebar or something else quite substantial).

Figure 3:
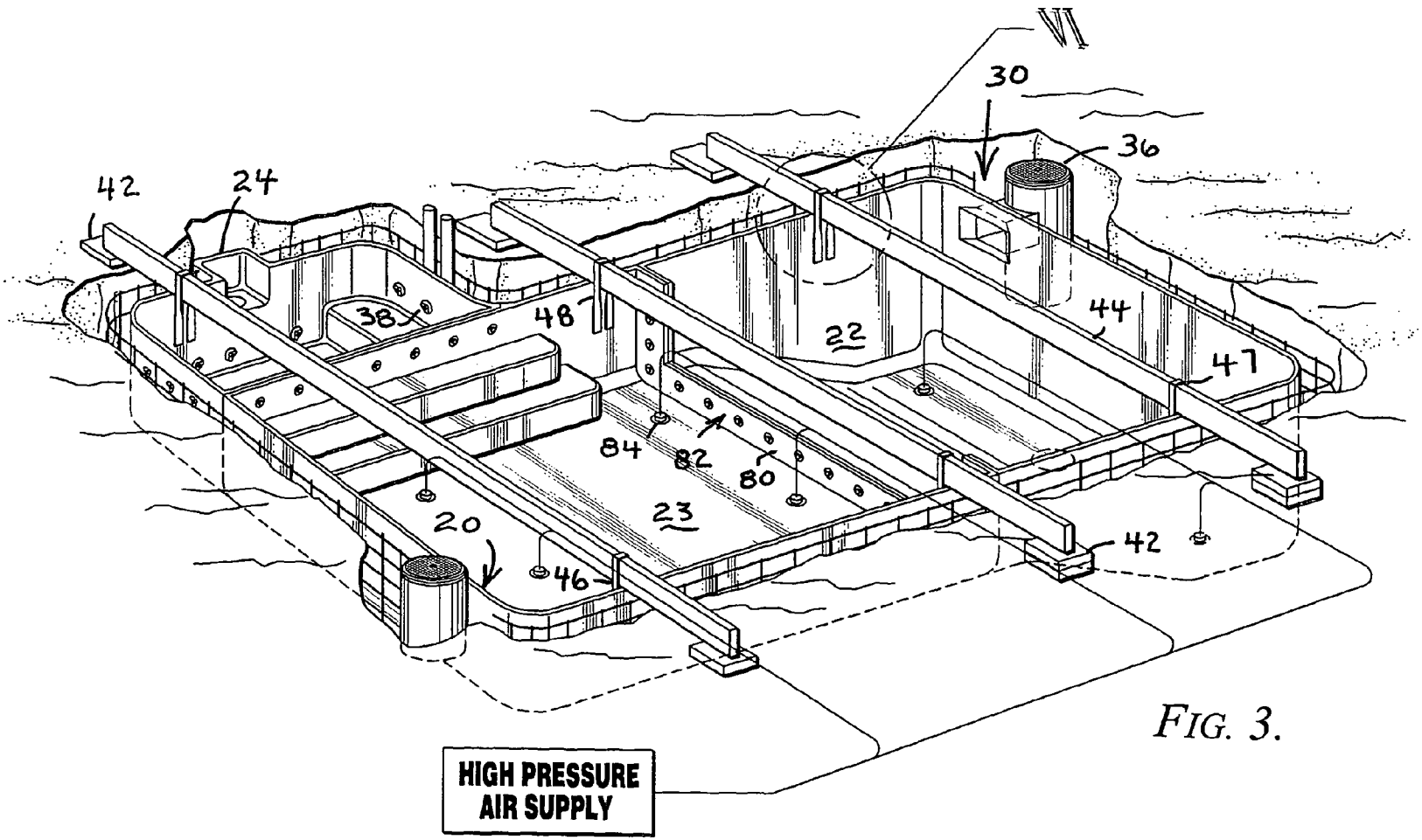
FIG. 3 is a perspective view comparable to FIG. 2 except showing a relatively further-along stage of the construction method in accordance with the invention.

FIGS. 2 and 3 show that certain plumbing (or other service/utility) features which eventually get cast tight into the concrete pour are also prepared in advance. Such features as shown in FIGS. 2 and 3 include without limitation drain features 34, skimmer features 36, and jet features 38 (as for, more particularly, the adjoining spa 12). Such features 34, 36 and 38 would otherwise include without limitation underwater lighting (not shown) and so on.

The core assembly 20 is assembled inside of or otherwise disposed in the prepared pit 30. Outside of the excavated edges of the pit 30, preferably on undisturbed ground, a series of leveling blocks 42 are placed on a distributed pattern according to the needs of the project. In FIG. 3, there are six (6) such leveling blocks 42, arranged in three pairs, each pair disposed across from each other along the long sides of the pit 30. Each pair of leveling blocks 42 supports one end of a transverse support beam 44. These transverse support beams 44 provide support for sets 46-48 of two or more hangers. The core assembly 20 is elevated up off the compacted-gravel base 32 of the pit 30 and suspended from the transverse support beams 44 by the hanger sets 46-18.

Figure 6:
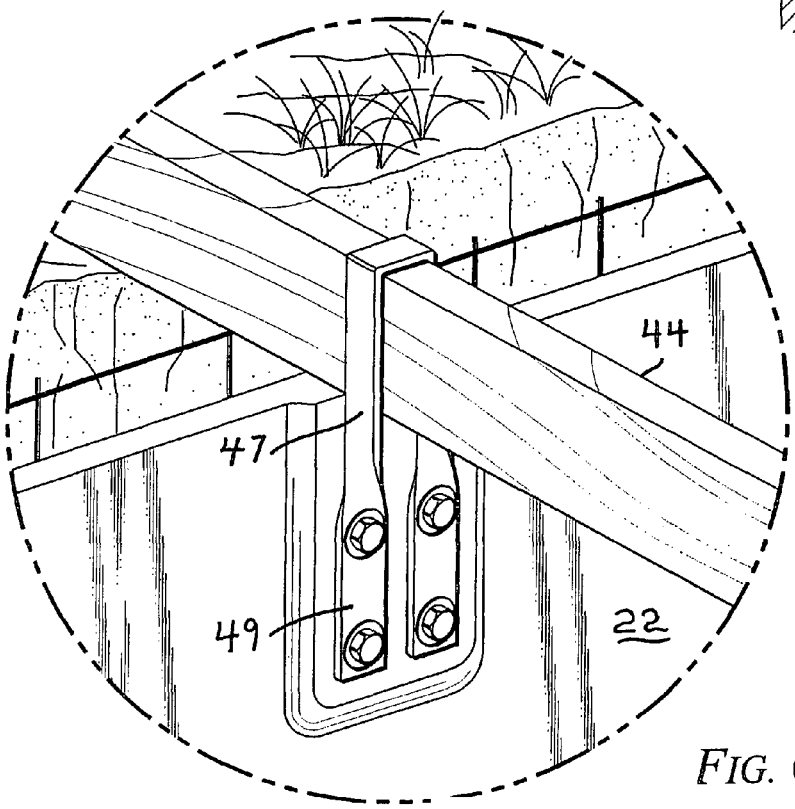
FIG. 6 is an enlarged-scale perspective view of detail VI in FIG. 3.

FIG. 6 shows in isolation one portion of the core section 22's sidewall with one of the hangers 47 affixed thereto, and being suspended by one the beams 44.

This core assembly 20 defines an open rectangular shape with an adjoining spa 12 (as shown for example by the drawings, but other core shapes include without limitation about any asymmetric or symmetric shape, as desired). So indeed, in the instance of having an open rectangular shape, the core assembly 12 is configured to have two long walls and two short walls defining the perimeter around a split level bottom. The bottom comprises a shallow end, a deep end, and an intermediate transition slope. The hangers 46-48 attach to the long walls of the core assembly 20, there being one pair of opposite hangers 46 for the shallow-end core section 23 in combination with the spa core section 24, another pair of the opposite hangers 47 for the deep-end core section 22, and then the third pair of opposite hangers 48 for the shallow-end core section 23 near its seam with the deep-end core section 22. More or less hangers are utilized on an as-needed or preference basis.

Referring once again to FIG. 6, preferably the hanger 48 and beam 44 are sized for the job. It is believed that certain large projects will require beams measuring four inches thick by ten inches tall (~ten cm×twenty-five cm). The hanger 48's legs 49 might be something like three to five feet long (~one to ~one-and-one-half m). That is, the hangers 46-48 not only serve to suspend the core assembly 20 off the compacted base 32 of the excavated pit 30 but their extra-long legs 49 (extra long legs not shown) also serve to stiffen the long walls against being warped inward during the concrete pour. In any event, the core assembly 20 is temporarily suspended in air. The support beams 44 can be timbers or metal tubes and the like but which, nevertheless, serve to carry the hangers 46-48 which suspend the core assembly 20.

The core assembly 20's state of being suspended in the pit 30 preferably comprises the state of things that there is a surrounding air-gap of clearance for a surrounding mass of wet concrete to be poured into and flow therebetween.

Figure 4:
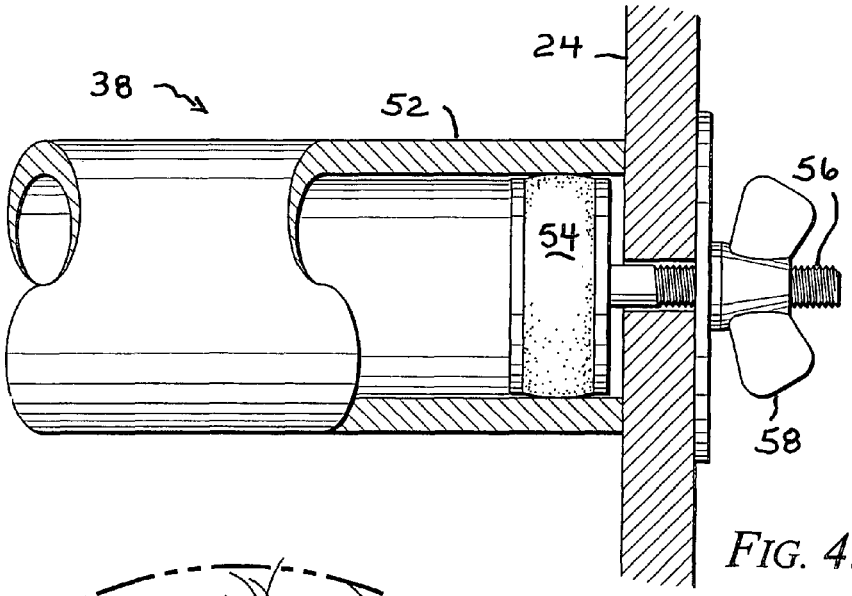
FIG. 4 is an enlarged-scale section view taken along line IV-IV in FIG. 2.

FIGS. 4 and 7-9 show how pre-planned features 34, 36 or 38 which are intended to be cast into the concrete pour are preserved. FIG. 4 shows a jet feature 38 for the spa 12, whose location in the project as a whole is indicated in FIG. 2. The jet feature 38 comprises a conduit 52 that fixed in a specified position, the terminal end of which would presumably lie flush with the cured concrete sidewall of the spa 12.

Hence, by design, this conduit 52 will be cast tight into the concrete pour, and permanently engulfed in the specified position. FIG. 4 shows several measures in accordance with the invention for combating wet concrete from leaking into the conduit 52. One measure is to insert a threaded-stud compression plug 54 into the conduit 52's terminal end. The core section 24 sidewall is formed with a hole for the threaded-stud 56 to stick through, and then the core section 24 is positioned in a manner so its outer surface is flush against the conduit 54's terminal end, allowing a user to tighten a nut 58 (eg., a wingnut in the drawing) on the compression-plug 54's threaded stud 56. It is an aspect of the invention that the core 20 provides a barrier between the wet, curing concrete and the ballast, which may be water. Whereas the optimized goal is to be leak-proof, perforating the core 20 with bolt holes may introduce minor leakage point but, nevertheless, a little leakage may be tolerable and hence a sufficient goal might be substantially leak resistant.

Figure 7:
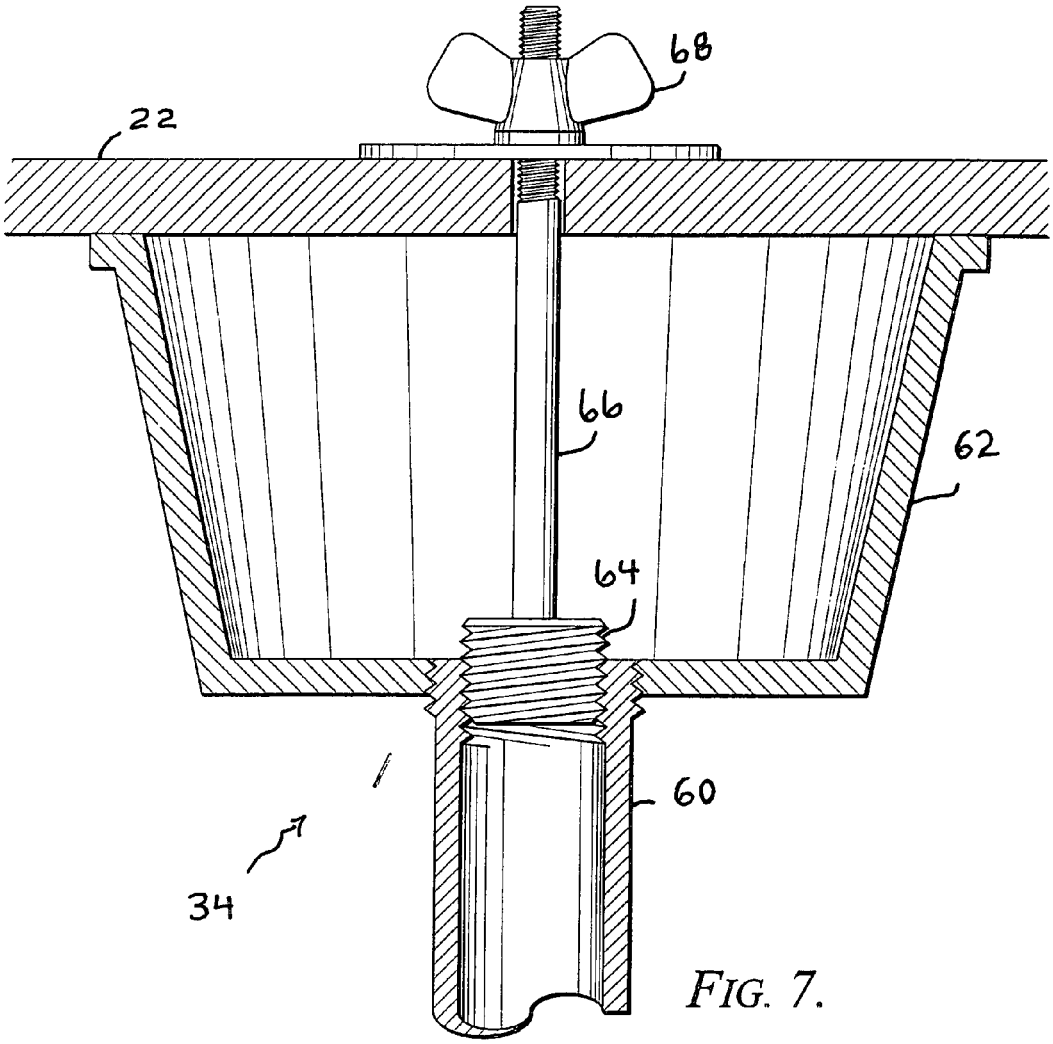
FIG. 7 is an enlarged-scale section view of detail VII-VII in FIG. 2.

FIG. 7 shows comparable measures in accordance with the invention for combating wet concrete from leaking into the drain features 34. The drain features 34 comprise a sink 60 and drain line 62, which are fixed in a specified position, the upper rim of the sink 60 which would presumably be coplanar with the cured concrete bottom of the swim pool. FIG. 7 shows countermeasures comparable but are alternatives to those of FIG. 4's, despite that FIG. 4's threaded-stud compression plug 54 would work here as well (albeit with a much longer stem for the threaded stud 56). Here in FIG. 7, some aspects of the drain features 34 are exploited for advantage. That is, the drain line 62 has a terminal end formed with not only external thread but internal thread as well. The drain line 62 is secured to the sink 60 by twisting the external thread into a threaded hole in the sink 60. That leaves the drain line 62's internal thread unused, and available for use. Accordingly, FIG. 7 shows not a compression plug 54 but a threaded plug 64 for twisting into the internal thread of the drain line 62. As comparable with FIG. 4, the core section 22 is formed with a hole for the threaded-stud 66 to stick through, and then the core section 22 is positioned in a manner so its bottom surface is flush against the sink 60's upper rim, allowing a user to tighten a nut 68 (eg., a wingnut in the drawing) on the threaded-plug 64's threaded stud 66.

Figure 9:
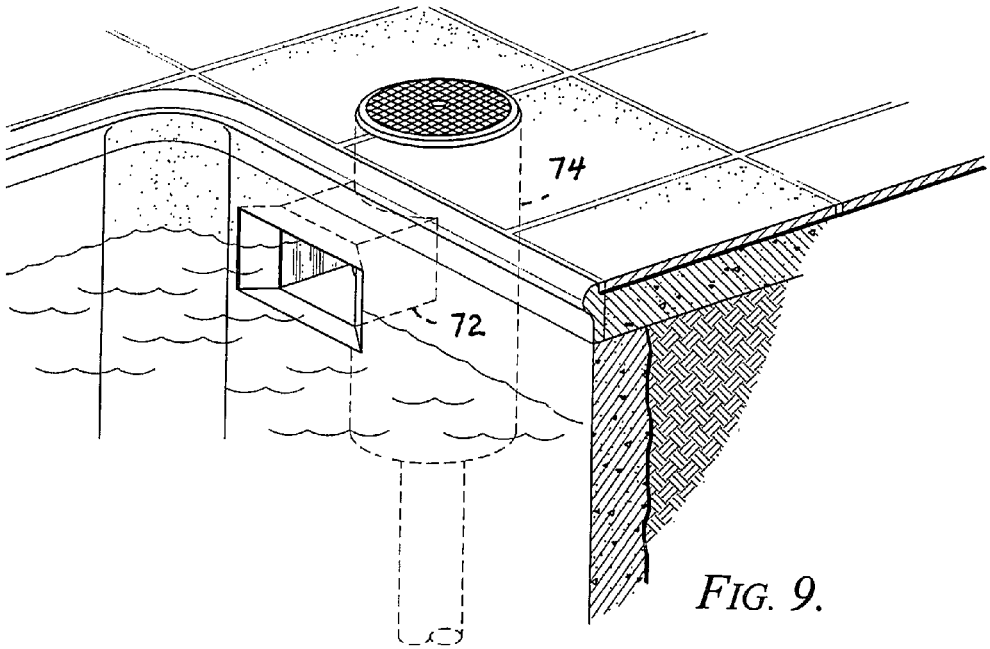
FIG. 9 is a perspective view comparable to FIG. 8 except showing the finished work with not only the core assembly removed but also the temporarily-used cover/bolt plate.
Figure 8:
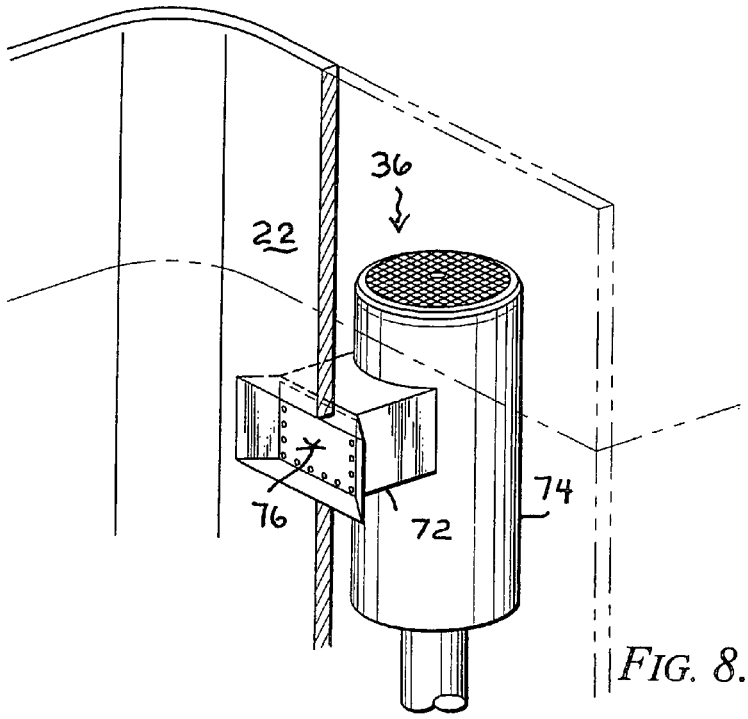
FIG. 8 is an enlarged-scale perspective view of detail VIII in FIG. 2.

And so on, for other passages, including what is shown by FIGS. 8 and 9. FIG. 8 shows representative skimmer features 36 comprising an intake 72 and a body column 74 that are set up in specified positions in advance of the concrete pour, and will indeed be engulfed firmly in the cured concrete. Preferably the intake 72 will be outfitted with a temporary cover/bolt plate 76. This temporary cover/bolt plate 76 serves several purposes. One, it covers the intake 72 so as to combat wet concrete from leaking in. Two, it provides an array of threaded sockets for bolts to tighten into. The core section 22 is provided with a matching array of through holes (not shown). That way, an array of bolts (not shown) can be extended outwards from the inside of the core section 22 to hit the cover/bolt plate 76, and then tighten in threaded sockets therein, which thereby draws the intake 72's mouth up flush against the outer surface of core section 22's sidewall.

FIG. 9 shows the finished job whereby not only has the core assembly 20 been removed but so also has the temporarily-used cover/bolt plate 76.

Figure 5:
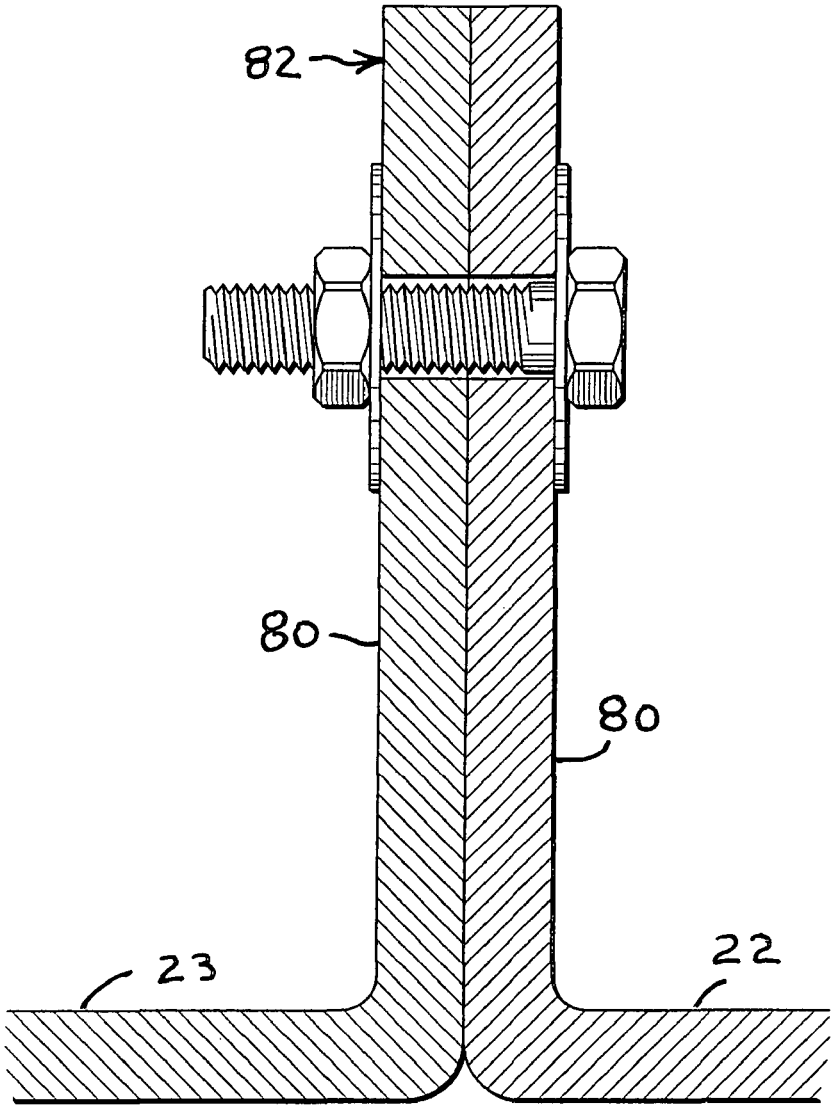
FIG. 5 is an enlarged-scale section view taken along line V-V in FIG. 2.

FIG. 5 shows how mating sections (eg., 22 and 23) of the core assembly 20 are provided with flanges 80 to mate together to form a flanged seam 82. The flanges 80 are bolted together to form a near watertight seal. Additional sealing power might be gained by running a sealant between the flanges 80. Suitable sealants including without limitation the room-temperature vinyls (eg., RTV's) including acetoxies (eg., smells like vinegar) and alkoxies (ie., non-acidic).

Pause can be taken to turn to general aspects of pouring the concrete. Concrete is initially poured between the excavated edge of the pit 30 and the core assembly 20's outer sidewall in order to be worked underneath the core assembly 20 for forming the pool floor. In order to keep the core assembly 20 from floating on the concrete pour, ballast water is poured into the core assembly 20. That is, the core assembly 20 is preferably watertight for indeed holding (ballast) water in, and not just concrete out.

The concrete pour on the outside of the core assembly 20 progresses along with the (ballast) water pour into the inside of the core assembly. Hence ballast water and concrete are poured at a rate which keeps the ballast water rising in the core assembly 20 faster than the concrete on the outside of the core assembly. One reason behind the progressive pour of the concrete in tandem with the progressive filling of the ballast is the following. The cooperative strength of the core assembly 20 and hangers 46-48 is surely insufficient to carry a full load of (ballast) water in the absence of any concrete. The core assembly 20 needs the progressively filling ballast to combat floating up on the progressively rising level of the wet concrete. But the converse is true too. That is, the core assembly 20 needs a progressively rising level of wet concrete in order to sustain a progressively rising level of ballast.

It is an aspect of the invention that the core assembly 20's sidewalls extend above the top of the intended height of the swim pool 10 (or spa 12) approximately two feet (~sixty cm) for additional water ballast capacity. That is, converse to the fact that wet concrete sinks in water, water is buoyant on wet concrete. So if the core walls were only as high as the intended height of the swim pool or spa shell, then the pour of wet concrete would float the water-filled core nonetheless (ie., wet concrete is about 2-⅓rd times as dense as water). However there are various countermeasures for combating this problem. One countermeasure includes not pouring all the concrete in at once, but in a series of stages, to intermediate fill levels. Each poured-in stage is allowed to set somewhat, before a succeeding stage of wet concrete is poured in on top of that (ie. preceding) stage to the succeeding stage's intermediate fill level, and so on, until the last stage:—the fill level for the intended height of the swim pool or spa shell (or at least the pour therefor).

Another countermeasure includes providing the core assembly's sidewalls with excess height above the top of the intended height of the swim pool or spa shell in order to provide additional water capacity. By design preference, approximately two feet (~sixty cm) of excess height is sufficient.

And so on, because if water is not sufficiently heavy (dense) for the purposes of keeping the core assembly 20 sunk in the concrete pour, sand may be added into the core assembly 20 such that the ballast inside the core assembly is actually sand (wet or not) rather than water alone (thereby having a density about the same as wet concrete). In any event, the poured concrete has to be allowed to harden before the core assembly 20 and its final fill-level of ballast is removed, which might be on the order of eight to twenty-four hours (indeed, longer is even better still).

After some extended time, the concrete hardens sufficiently that the core assembly 20 and its rigging apparatus can be removed. That is, the ballast is pumped or otherwise withdrawn out, whether particulate and/or water alone. The fasteners along the flanged seam 82 are removed. The core assembly is provided with a series of air-purge nozzles 84 such that pressurized air can be utilized for causing the concrete to release the sections 22-24 of the core assembly 20. The support beams 44 and hangers 46-48 might be temporarily left in place so that cranes or other overhead lifts might be utilized to lift out the core assembly 20 as a unit or by its disassembled sections 22-24.

At the end, all the core sections 22-24 and rigging equipment are disassembled for transportation off the project site. The concrete pool 10 (or spa 12) is allowed to cure additionally until some finishing operations are performed such as grinding, painting and/or plastering.

FIG. 1 shows off the end-product obtainable through practice of the method in accordance with the invention:—a highly appealing in-ground concrete swim pool.

It is an aspect of the invention that the cores or cores sections which mate together to make a core assembly are re-usable at least for dozens of projects if reasonably maintained and cleaned.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of producing in-ground spas or pools from concrete pours around liner-like cores, the liner-like cores being located in a cavity and defining sidewalls and floors, wherein the method comprising the steps of:

excavating a cavity below the spa's or pool's ground plane;

supplying a thin-walled, leak-resistant core whose outer contour substantially defines the form of the cavity;

suspending the core using a suspension system around the excavated cavity such that there is a surrounding air-gap of clearance between said core and said cavity;

introducing ballast into the core gradually;

pouring wet concrete gradually with said air-gap the initiation of the pouring follows the introducing of the ballast;

continuing to introduce ballast and pouring such that the amount of ballast remains greater than the amount of wet concrete, so that the ballast combats the core from dislodging from position and floating up during the pouring of wet concrete;

allowing the wet concrete to harden;

removing the ballast;

applying a dislodging force between the hardened concrete and the core; and removing the core.

2. The method of claim 1 further comprising the step of:

re-using the core to produce another in-ground spa or pool.

3. The method of claim 2 wherein:

the step of supplying said core further comprises supplying core sections to assemble together in an assembly comprising said core overall, said core sections meeting at mating flanges to form flanged seams which are temporarily joined in a leak-resistant state; and the step of removing the core further comprises disassembling the core overall into the separate core sections once again for separate transportation to the job site for the other spa or pool.

4. The method of claim 3 further comprising:

configuring said core overall with sidewall extensions that tower above the spa's or pool's ground plane by at least two feed (~sixty cm) so that the core overall can be filled with ballast to levels higher than the ground plane for the wet concrete pour.

5. The method of claim 3 wherein:

said flanged seams are temporarily bolted together for the pour of wet concrete, after the hardening of which, are un-bolted so the core overall can be disassembled once again into the separate core sections.

6. The method of claim 1 wherein:

the dislodging force applied between the hardened concrete and the core comprises pressurized air.

7. The method of claim 6 wherein:

the step of supplying a core further comprises providing the core with a series of air-purge nozzles whereby pressurized air can be utilized for causing hardened concrete to release the core after allowing the wet concrete to harden.

8. The method of claim 1 wherein:

the core is manufactured of material resistant to degradation by curing concrete and is re-usable for dozens of more of projects if reasonably maintained and cleaned after each use.

9. The method of claim 8 wherein:

the core's material comprises fiberglass.

* * * * *